US005099530A

United States Patent [19]

Scott

[11] Patent Number: 5,099,530

[45] Date of Patent: Mar. 31, 1992

[54] COVER FOR EXERCISE PAD

[76] Inventor: Carolyn A. Scott, 610 Cresline, Houston, Tex. 77076

[21] Appl. No.: 603,026

[22] Filed: Oct. 25, 1990

[51] Int. Cl.[5] ..... A47G 9/00; A47G 9/06

[52] U.S. Cl. ..... 5/420; 5/419; 5/470; 5/485; 5/500

[58] Field of Search ..... 5/417–420, 5/470, 485, 499, 500, 502, 413

[56] References Cited

U.S. PATENT DOCUMENTS

| | | | |
|---|---|---|---|
| 2,832,394 | 2/1958 | Smith | 5/470 |
| 3,148,388 | 9/1964 | Espersen | 5/485 |
| 3,262,134 | 9/1966 | Bramble, Jr. | 5/420 |
| 3,579,675 | 5/1975 | Scheer | 5/416 |
| 3,774,249 | 11/1973 | Ybarra et al. | 5/419 |
| 4,601,076 | 7/1986 | Knobeloch | 5/413 |

*Primary Examiner*—Michael F. Trettel
*Attorney, Agent, or Firm*—Kenneth A. Roddy

[57] ABSTRACT

A washable fabric cover fits over a folding exercise or rest mat or pad and can be folded with the pad inside into a compact package for carrying. The cover is a generally rectangular envelope having a head portion and a foot portion and is enclosed at the end of the head portion and along its opposed longitudinal sides and open at the end of the foot portion to form a top layer and a bottom layer of material. A pocket on the top layer at the head portion removably receives a pillow or other articles. A length of material extends outwardly from the open end to be folded over and substantially cover the top layer to serve as a blanket to cover a person laying on the covered pad and can be folded and received within the open end in a stored condition. A pair of flexible loops secured to the bottom layer form carrying straps when the cover and the enclosed pad is in the compact package for carrying. The cover with the enclosed pad is foldable accordian style such that the pocket is disposed on an outer side of the folded configuration or can be folded inwardly upon itself from each end such that the pocket is disposed on the inside of the folded configuration. Alternatively, the sheet portion may be removable and a second pocket may be provided on the bottom layer at the foot portion for storing the sheet portion or other articles.

14 Claims, 2 Drawing Sheets

COVER FOR EXERCISE PAD

BACKGROUND OF THE INVENTION

1. Field of the Invention

This invention relates generally to exercise or sleeping pad covers, and more particularly to a fabric cover which fits over a folding exercise or rest pad and has an integral sheet portion and a pocket for receiving a pillow and may be folded with the pad into a compact easily carried configuration.

2. Brief Description of the Prior Art

Folding exercise and rest mats and pads are popular items. Such mats or pads are conventionally made of a soft resilient inner material, such as foam rubber covered with a washable plastic outer covering. These types of mat and pads are used in nurseries, schools, and aerobic facilities because they are easily cleaned and stored in a folded condition.

However, the plastic outer covering causes heat to build up between the skin of the child or adult resting or exercising thereon and as a result the skin has tendency to stick to the outer covering. These pads can also become slippery during periods of vigorous exercise if the person is sweating which increases the risk of injury due to slipping and falling.

These pads are not usually washed after each day's use, and there is no assurance that the same person will use the same pad each time or that the same side of the pad is placed on the floor each time it is used. This presents a health risk since germs may be transmitted through contaminated pads.

There are several patents which disclose various rest mats and folding articles.

Brown, U.S. Pat. No. 3,222,695 discloses a kindergarten rest mat formed of flexible material which has a head portion and a foot portion with unitary flaps extending laterally from the head portion. The mat is provided with snap fasteners whereby it can be secured in a rolled condition.

Sneider, U.S. Pat. No. 4,154,323 discloses a multi-purpose diaper bag which holds diapers and other supplies and has a strip of material detachably secured to an inner portion of the bag which may be rolled up and secured within the bag or unrolled to provide a surface upon which a baby may be placed when changing diapers.

The present invention is distinguished over the prior art in general, and these patents in particular by a washable fabric cover which fits over a folding exercise or rest pad and can be folded into a compact package for carrying. The cover is a generally rectangular envelope having a head portion and a foot portion and is enclosed at the end of the head portion and along its opposed longitudinal sides and open at the end of the foot portion to form a top layer and a bottom layer of material. A pocket on the top layer at the head portion removably receives a pillow or other articles. A length of material extends outwardly from the open end to be folded over and substantially cover the top layer to serve as a blanket to cover a person laying on the top layer and can be folded and received within the open end in a stored condition. A pair of flexible loops secured on the bottom layer form carrying straps when the cover and the enclosed pad is in the compact package for carrying. The cover with the enclosed pad is foldable accordian style such that the pocket is disposed on an outer side of the folded configuration or can be folded inwardly upon itself from each end such that the pocket is disposed on the inside of the folded configuration. Alternatively, the sheet portion may be removable and a second pocket may be provided on the bottom layer at the foot portion for storing the sheet portion or other articles.

SUMMARY OF THE INVENTION

It is therefore an object of this invention to provide a fabric cover which is easily installed over a folding exercise o rest pad and is easily removed.

It is another object of this invention to provide a fabric cover for folding exercise or rest pads which is washable.

Another object of this invention is to provide a fabric cover for folding exercise or rest pads which has an integral sheet portion which can be either folded and stored in the cover or unfolded to cover the person occupying the pad.

Another object of this invention is to provide a fabric cover for folding exercise or rest pads which has an integral pocket at the head portion for receiving a pillow for added comfort to the person occupying the pad.

Another object of this invention is to provide a fabric cover for folding exercise or rest pads which has one or more integral pockets for storing or transporting various articles when the cover is folded.

A further object of this invention is to provide a fabric cover for folding exercise or rest pads which has an integral sheet portion and an integral pocket at the head portion whereby the sheet portion and pillow may be stored in the cover and the cover with the pad inside can be folded into an easily carried compact package.

A still further object of this invention is to provide a fabric cover for folding exercise or rest pads which has an integral sheet portion and an integral pocket at the head portion which is simple in construction, economical to manufacture and durable in use.

Other objects of the invention will become apparent from time to time throughout the specification and claims as hereinafter related.

The above noted objects and other objects of the invention are accomplished by a washable fabric cover which fits over a folding exercise or rest pad and can be folded with the pad inside into a compact package for carrying. The cover is a generally rectangular envelope having a head portion and a foot portion and is enclosed at the end of the head portion and along its opposed longitudinal sides and open at the end of the foot portion to form a top layer and a bottom layer of material. A pocket on the top layer at the head portion removably receives a pillow or other articles. A length of material extends outwardly from the open end to be folded over and substantially cover the top layer to serve as a blanket to cover a person laying on the covered pad and can be folded and received within the open end in a stored condition. A pair of flexible loops secured to the bottom layer form carrying straps when the cover and the enclosed pad is in the compact package for carrying. The cover with the enclosed pad is foldable accordian style such that the pocket is disposed on an outer side of the folded configuration or can be folded inwardly upon itself from each end such that the pocket is disposed on the inside of the folded configuration. Alternatively, the sheet portion may be removable and a second pocket may be provided on the bottom layer at the foot portion for storing the sheet portion or other articles.

DESCRIPTION OF THE PREFERRED EMBODIMENT

Figure 1:
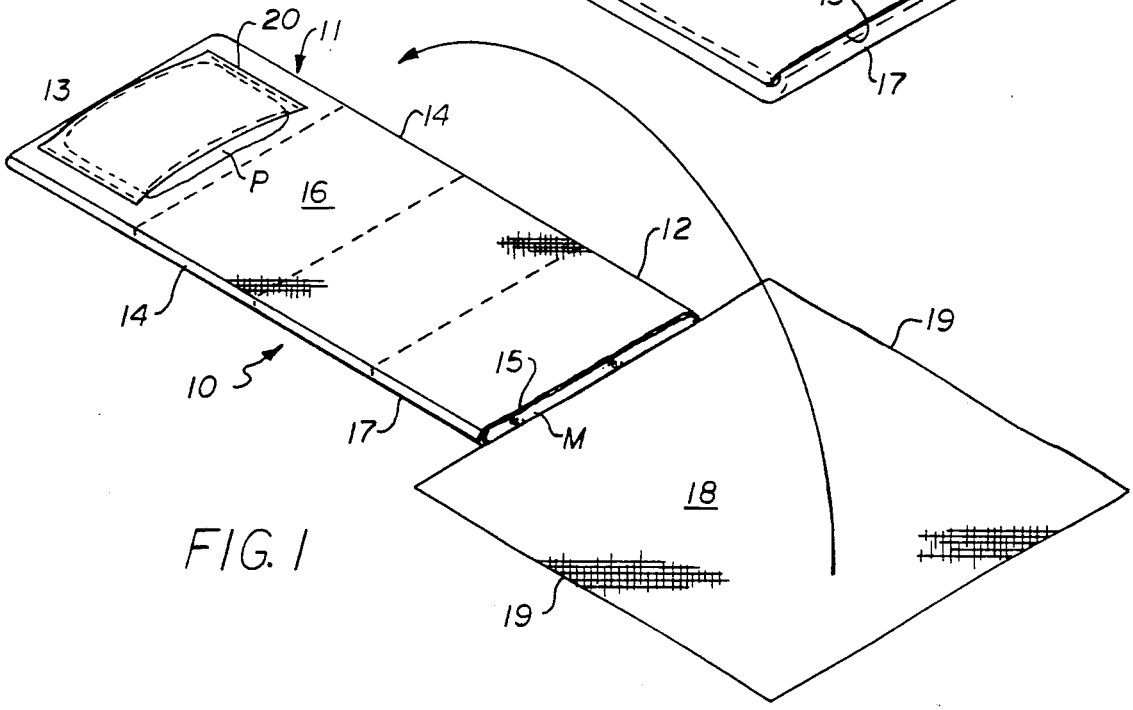
FIG. 1 is an isometric view of a fabric cover for folding exercise or rest pads in accordance with the present invention shown in an unfolded condition and the sheet portion folded outwardly.

Referring to the drawings by numerals of reference, there is shown in FIG. 1, a preferred fabric cover 10 in an unfolded condition. The cover 10 is a generally rectangular configuration constructed of a suitable cloth or fabric material which is easily washable. The cover 10 is sewn to form a rectangular envelope having a head portion 11 and a foot portion 12. The envelope is enclosed at the end 13 of the head portion 11 and along the opposed longitudinal sides 14 and is open at the end 15 of the foot portion 12 to form a top layer 16 and bottom layer 17 of material.

Figure 3:
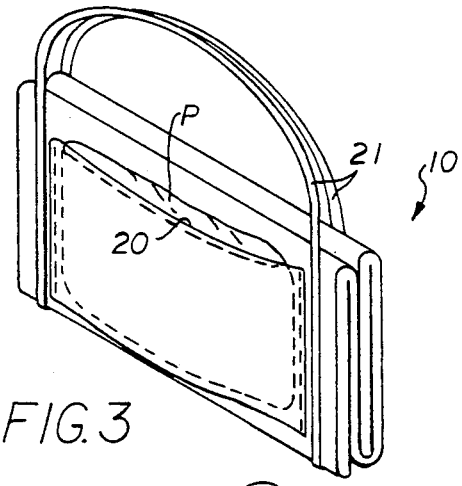
FIG. 3 is an isometric view of the fabric cover including a folding exercise or rest pad shown folded into a compact folded configuration for carrying.
Figure 3A:
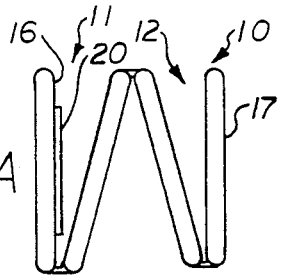
FIG. 3A is a side elevation of the fabric cover having a pocket on the top layer shown being folded to place the pocket on the inside of the folded configuration.

The bottom layer of material 17 has a extended portion 18 which extends outwardly from the open end 15 of the foot portion 12 and is approximately three-fourths the length of the rectangular top layer 16. The width of the extended portion 18 of the bottom layer 17 is greater than the width of the top layer 16 to define laterally opposed longitudinal side edges 19. A relatively large pocket 20 is sewn onto the top layer 16 at the head portion 11. A pair of fabric loops are sewn onto the bottom layer to form carrying straps 21 (FIG. 3).

In the position shown in FIG. 1, a flexible exercise or rest pad or mat M can be inserted into the open end 15 of the foot portion 12 of the envelope such that the cover 10 substantially covers the mat. The extended portion 18 can then be folded and inserted into the open end 15.

To accomplish the folding procedure, the longitudinal side edges 19 are folded in toward the center such that the folded width of the extended portion 18 is approximately the same as the width of the open end 15. The extended portion 18 is then folded onto itself toward the open end 15 several times until it is approximately one-fourth the length of the rectangular top layer 16. The portion 18 in the folded condition can then be inserted into the open end to reside between the top surface of the pad or mat M and the underside of the top layer 16 occupying approximately one-fourth the length of the cover 10, as shown in dotted line in FIG. 2. In this manner, the end of the pad or mat M is also covered by the inwardly folded portion 18. This also retains the mat inside the cover and prevents it from slipping out during exercise.

Figure 2:
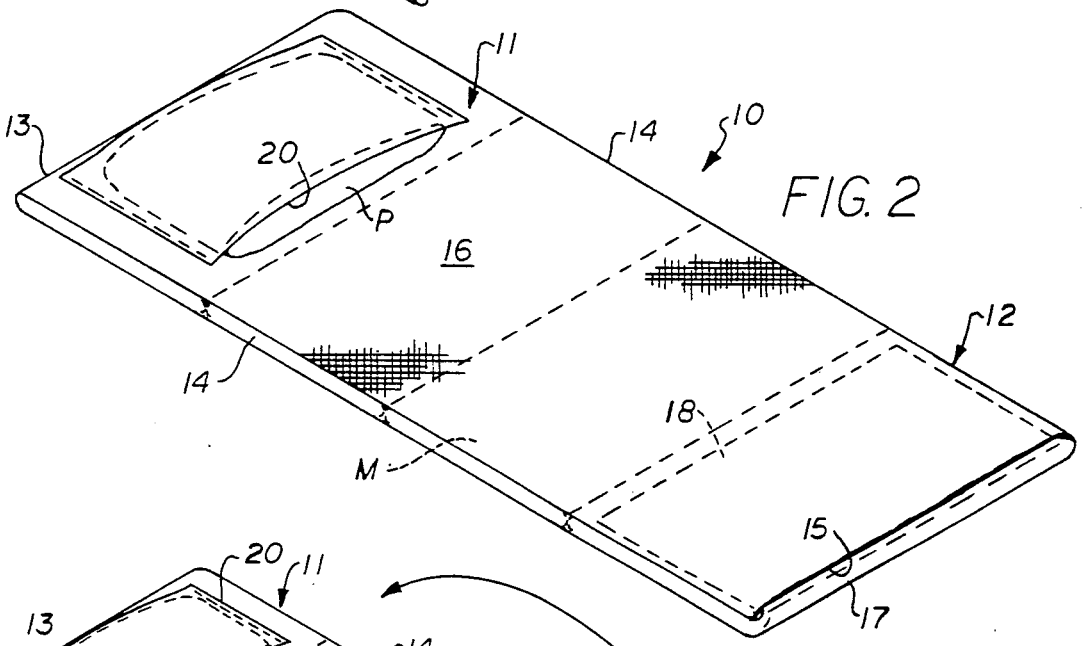
FIG. 2 is an isometric view of the fabric cover for folding exercise or rest pads of FIG. 1 in an unfolded condition with the sheet portion folded in a stored condition.

In the position shown in FIG. 2, the pad or mat M is completely covered by the fabric cover 10, and the covered mat can be used for exercising or for resting. Since the carrying straps 21 are on the bottom layer, they present no problem. For added comfort during resting, a pillow P can be installed into the pocket 20.

Referring now to Figs. 1 and 2, when the covered pad or mat is unfolded (FIG. 2), the folded and stored extended portion 18 can be pulled outwardly from the open end 12, unfolded, and then placed over the top layer 16 (FIG. 1) covering approximately three-fourths of its length. In this manner, the extended portion 18 serves as a blanket or cover for a person laying on the top layer 16 of the covered mat. Since the laterally opposed longitudinal side edges 19 of the extended portion 18 are wider than the top layer 16, the longitudinal side edges can be folded underneath the side edges 14 of the envelope to secure the extended portion 18 in position as a blanket or cover.

As shown in FIG. 3, the cover 10 with the pad or mat M enclosed inside can be folded into a compact package for carrying. The cover and mat may be folded accordian style such that the pocket 21 is disposed on the exterior side of the folded configuration. The pillow P can also be carried in the pocket in the folded condition, or the pocket may be used for carrying various other articles, such as clothing or notebooks. The cover with the mat enclosed can also be folded inwardly from each end such that the pocket 20 including the pillow or other articles is disposed on the inside of the folded configuration.

In the unfolded condition, the pad or mat can be easily removed from the cover by sliding it out of the open end 15 so that the cover can be washed.

Figure 4:
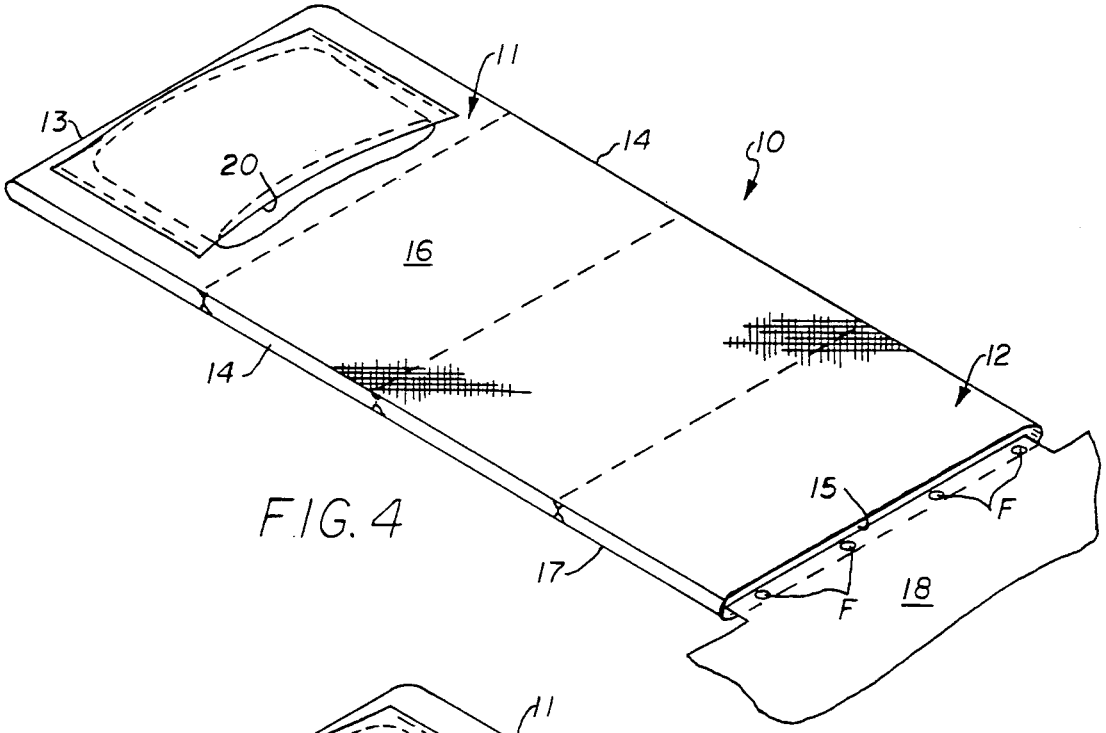
FIG. 4 is an isometric view of another embodiment of the fabric cover of the present invention having a removable sheet portion.

Optionally, as shown in FIG. 4, the extended portion 18 may be a separate sheet of material which is releasably fastened to the open end 15 of the foot portion 12. In this embodiment, the bottom layer 17 at the open end 12 is provided with fasteners F and one end of the extended portion 18 is provided with mating fasteners F whereby the extended portion may be selectively attached or removed. The fasteners F may any conventional fastening means such as snaps or mating strips of hook and loop fabric fastener elements.

Figure 5:
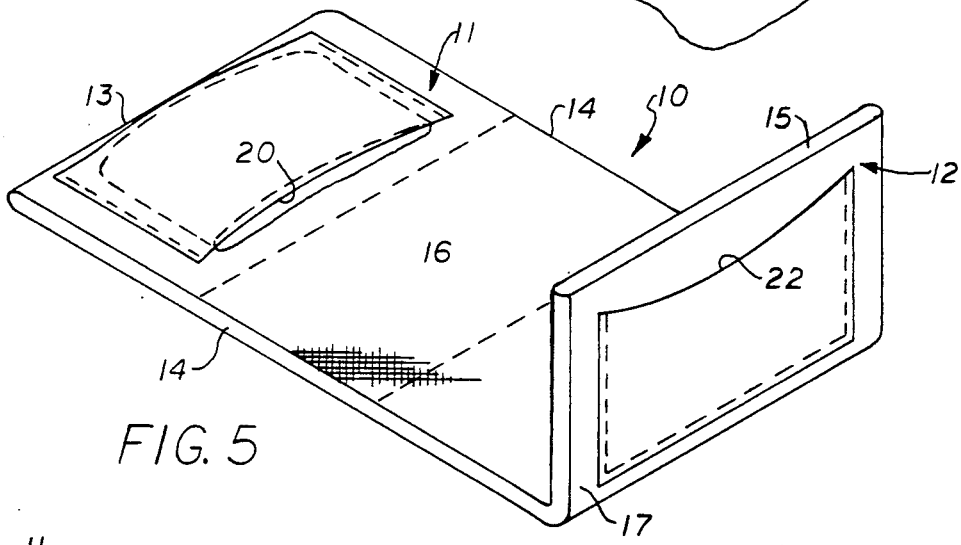
FIG. 5 is an isometric view of another modification of the fabric cover of the present invention having a second pocket on the bottom portion.
Figure 6:
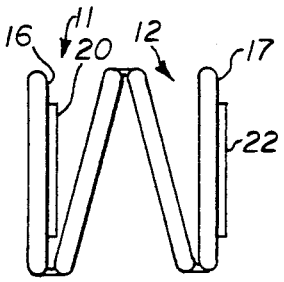
FIG. 6 is a side elevation of the fabric cover having a first pocket on the top layer and a second pocket on the bottom layer shown being folded to place one of the pockets on the outside and the other pocket on the inside of the folded configuration.
Figure 7:
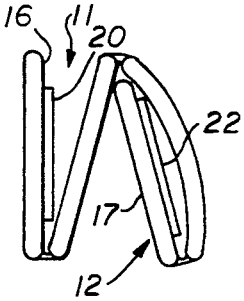
FIG. 7 is a side elevation of the fabric cover having a first pocket on the top layer and a second pocket on the bottom layer shown being folded to place both of the pockets on the inside of the folded configuration.

As seen in FIG. 5, a second relatively large pocket 22 may be sewn onto the bottom layer 17 at the foot portion 12 to provide additional storage. The cover with the mat inside may be folded accordian style such that either pocket 20 or 22 are disposed on the exterior side of the folded configuration, as shown in FIG. 6, and as seen in FIG. 7, the cover with the mat inside can be folded upon itself from each end to place both pockets 20 and 22 on the inside of the folded configuration. The pillow P can be carried in one pocket and the removable extended portion or sheet 18 may be stored in the other pocket.

While this invention has been described fully and completely with special emphasis upon a preferred embodiment, it should be understood that within the scope of the appended claims the invention may be practiced otherwise than as specifically described herein.

I claim:

1. The combination of a cover and a folding exercise or rest pad comprising;

a folding exercise or rest pad, a generally rectangular envelope of flexible material having head portion and a foot portion, said envelope enclosed at the end of said head portion and along its opposed longitudinal sides and open at the end of said foot portion to form a top layer and a bottom layer of material, said rectangular envelope and said open end being sized to slidably receive and substantially enclose said folding exercise or rest pad, and a pocket on said top layer at said head portion of sufficient size to removably receive a pillow or other article therein, said envelope with said folding exercise or rest pad enclosed therein being foldable as a unit into a compact package configuration for carrying, and said envelope with said folding exercise or rest pad enclosed therein being selectively foldable as a unit either accordian style to place said pocket on an outer side of the folded configuration or folded inwardly upon itself from each end to place said pocket on the inside of the folded configuration.

2. The combination according to claim 1 wherein said envelope of material comprises a washable fabric material.

3. The combination according to claim 1 including a second pocket on said bottom layer at said foot portion of sufficient size to removably receive a pillow or other article therein, and said envelope with said folding exercise or rest pad enclosed therein being selectively foldable as a unit either accordian style to place one of said pockets on an outer side of the folded configuration and the other said pocket on the inside of said folded configuration or folded inwardly upon itself from each end to place both said pockets on the inside of the folded configuration.

4. The combination according to claim 1 including a generally rectangular length of foldable material extending outwardly from said open end of said foot portion and having sufficient length and width to be overlayed on said top layer to substantially cover said top layer in an extended condition and serve as a blanket to cover a person laying on said top layer, and said length of material in a folded and stored condition being smaller than said envelope and received and stored within said open end of said foot portion.

5. The combination according to claim 4 in which said generally rectangular length of material is an extension of said bottom layer and having a length approximately three-fourths of the length of said top layer and a width greater than the width of said top layer.

6. The combination according to claim 5 in which said generally rectangular length of material in the extended condition having a width greater than the width of said envelope such that its laterally opposed longitudinal side edges are received underneath and side edges of said envelope to aid in maintaining said length of material in position as a blanket over said top layer.

7. The combination according to claim 5 in which said generally rectangular length of material in the folded and stored condition received in said envelope open end to reside between the top surface of said exercise or rest pad enclosed in said envelope and the underside of said top layer to enclose said envelope open end and cover the end of the enclosed pad.

8. The combination according to claim 1 including a pair of flexible loops secured on said bottom layer to form carrying straps when said envelope with said folding exercise or rest pad enclosed therein is in said compact package configuration for carrying.

9. A cover for folding exercise or rest pads comprising;

a generally rectangular envelope of flexible material having a head portion and a foot portion, said envelope enclosed at the end of said head portion and along its opposed longitudinal sides and open at the end of said foot portion to form a top layer and a bottom layer of material, said rectangular envelope and said open end being sized to slidably receive and substantially enclose a folding exercise or rest pad, a first pocket on said top layer at said head portion of sufficient size to removably receive a pillow or other article therein, and a second pocket one said bottom layer at said foot portion of sufficient size to removably receive a pillow or other article therein, said envelope with the folding exercise or rest pad enclosed therein being foldable as a unit into a compact package configuration for carrying, said envelope with the folding exercise or rest pad enclosed therein being selectively foldable as a unit either accordian style to place one of said pockets on an outer side of the folded configuration and the other said pocket on the inside of said folded configuration or folded inwardly upon itself from each end to place both said pockets on the inside of the folded configuration.

10. A cover for folding exercise or rest pads according to claim 9 including a generally rectangular length of foldable material extending outwardly from said open end of said foot portion and being of sufficient length and width to be overlayed on said top layer and substantially cover said top layer in an extended condition to serve as a blanket to cover a person laying on said top layer, and said length of material being foldable upon itself into a compact folded configuration smaller than said envelope and the compact folded length of material received and stored within said open end of said foot portion in the folded and stored condition.

11. A cover for folding exercise or rest pads according to claim 10 in which said generally rectangular length of material is an extension of said bottom layer and having a length approximately three-fourths of the length of said top layer and a width greater than the width of said top layer.

12. A cover for folding exercise or rest pads according to claim 11 in which the width of said generally rectangular length of material in the extended position is greater than the width of said envelope such that its laterally opposed longitudinal side edges can be folded underneath the side edges of said envelope to aid in maintaining said length of material in position as a blanket over said top layer.

13. A cover for folding exercise or rest pads according to claim 11 in which said generally rectangular length of material in the folded and stored condition received in said envelope open end to reside between the top surface of an exercise or rest pad enclosed in said envelope and the underside of said top layer to enclose said envelope open end and cover the end of the enclosed pad.

14. A cover for folding exercise or rest pads according to claim 9 including a pair of flexible loops secured on said bottom layer to form carrying straps when said envelope with the folding exercise or rest pad enclosed therein is in said compact package configuration for carrying.

* * * * *